US009156074B2

(12) United States Patent
Beissel et al.

(10) Patent No.: US 9,156,074 B2
(45) Date of Patent: Oct. 13, 2015

(54) METHOD FOR PRODUCING A LARGE STEEL TUBE

(75) Inventors: Jochem Beissel, Hilchenbach (DE); Thilo Reichel, Wilnsdorf (DE)

(73) Assignee: Eisenbau Krämer GmbH, Kreuztal (DE)

( * ) Notice: Subject to any disclaimer, the term of this patent is extended or adjusted under 35 U.S.C. 154(b) by 994 days.

(21) Appl. No.: 12/737,077

(22) PCT Filed: May 28, 2009

(86) PCT No.: PCT/EP2009/003816

§ 371 (c)(1), (2), (4) Date: Feb. 22, 2011

(87) PCT Pub. No.: WO2009/146838

PCT Pub. Date: Dec. 10, 2009

(65) Prior Publication Data

US 2011/0174046 A1 Jul. 21, 2011

(30) Foreign Application Priority Data

Jun. 6, 2008 (DE) ..... 10 2008 027 807

(51) Int. Cl.

| | |
|---|---|
| ***B21D 3/10*** | (2006.01) |
| ***B21D 5/10*** | (2006.01) |
| ***B21C 37/30*** | (2006.01) |
| ***B21C 37/08*** | (2006.01) |
| ***B21D 5/14*** | (2006.01) |

(52) U.S. Cl.

CPC ..... *B21D 3/10* (2013.01); *B21C 37/0807* (2013.01); *B21C 37/30* (2013.01); *B21D 5/10* (2013.01); *B21D 5/14* (2013.01)

(58) Field of Classification Search

CPC ..... B21D 3/10; B21D 5/015; B21D 5/10; B21C 37/0807; B21C 37/30

USPC ..... 72/48, 51, 31.03, 31.06, 308, 311, 72/370.13, 370.22, 381, 383, 384, 386, 72/402, 56–58

See application file for complete search history.

(56) References Cited

U.S. PATENT DOCUMENTS

| | | | | |
|---|---|---|---|---|
| 7,818,986 | B1 * | 10/2010 | Parker et al. | 72/58 |
| 2008/0092615 | A1 * | 4/2008 | Bruggernbrock | 72/51 |

FOREIGN PATENT DOCUMENTS

| | | | |
|---|---|---|---|
| DE | 41 24 689 | A1 | 1/1993 |
| DE | 196 02 920 | A1 | 7/1997 |
| DE | 10 2006 010 040 | B3 | 10/2007 |
| EP | 0 438 205 | A2 | 7/1991 |
| EP | 1 089 835 | B1 | 3/2002 |
| FR | 737.123 | | 12/1932 |

* cited by examiner

*Primary Examiner* — Debra Sullivan

(74) *Attorney, Agent, or Firm* — Pauley Erickson & Kottis

(57) ABSTRACT

A method for producing a steel tube, wherein a steel sheet is formed into tubular body having a round cross section in a bending process, welded in a subsequent welding process along longitudinal edges facing each other for producing a continuous longitudinal seam, and then subjected to a stress-relieving treatment. The production quality is improved, with reduced production time, because the stress-relieving treatment is performed in a process for concentrically truing along the circumference in at least one segment relative to the longitudinal axis thereof, while cold forming by compression (FIG. 1). The mechanical technological properties of the material are also thereby improved.

7 Claims, 2 Drawing Sheets

METHOD FOR PRODUCING A LARGE STEEL TUBE

BACKGROUND OF THE INVENTION

1. Field of the Invention

This invention relates to a method for producing a steel tube, in which a metal sheet or coil is formed in a bending process to a tubular body having a round cross section, is welded in an ensuing welding process along the longitudinal edges facing one another to produce one continuous seam, and is then subjected to a stress-relieving treatment.

2. Discussion of Related Art

One method of this type is described in German Patent Disclosure DE 10 2006 010 040 B3. In this known method, the tube is compressed by a straightening machine from the outer circumference, by a plurality of welding devices, offset in a circumferential direction and located at an identical location in the axial direction, for concentric straightening. The welding devices have straightening shells adapted to the shape of the outer cross section of the tube. The straightening shells can be driven, for instance hydraulically, individually or in dependence on one another, and the actuation can be done by open-loop or closed-loop control. Via the closed-loop control axes, the straightening cylinders, with the straightening shells, can straighten the tube until its contour is circular, and the calibration is done with respect to the diameter and/or the ovality. Upsetting of the material past the elongation limit is also possible with what is called here for the first time impansion.

European Patent Disclosure EP 0 438 205 A2 shows a method and an apparatus for straightening the ends of elongated workpieces. With the workpiece at a standstill, at least one cross section, sought in the end region, is subjected to an alternating increasing and decreasing bending stress, and a predetermined maximum sag extends around the workpiece axis once or multiple times. An alternating increasing and decreasing bending stress is selected so that the cross section sought is deformed into the plastic range. To generate a deflection of the workpiece axis into an orbit past or beyond the limit of elasticity of the workpiece there are at least three tappets, movable in the radial direction and disposed symmetrically about a common axis, which are each connected to a travel- and time-dependently controllable piston-cylinder unit. The tappets, as a result of a controlled linkage of the piston-cylinder units to one another, execute a sinusoidal reciprocating motion in phase-offset fashion during the straightening process. In this case, straightening is not effected with regard to roundness or ovality but rather a correction is made of deviations in rectilinearity of the crooked ends, such as longitudinal straightening.

With a straightening machine for tubes shown in French Patent Disclosure FR 737 123 A, these tubes are also straightened in their longitudinal direction, specifically in the warm state. Here, two opposed straightening elements, which between them receive the tube and can be pressed against one another by a lever mechanism with a drive, extend over an entire length of the tube. The straightening elements are for example rounded in accordance with the diameter of the tube, and the inner part of the straightening elements can be replaceable. Before the straightening process, the tubes are heated to the red-hot state and are evacuated. After the performed longitudinal straightening, the tubes are delivered by an ejector to a cooling device. Straightening large steel tubes, in particular, by such methods or provisions is complicated, and problems and solutions for concentric straightening are not found in this reference.

In German Patent Disclosure DE 196 02 920 A1, a method for producing tubes, in particular large tubes, is disclosed in which the tubes are calibrated and straightened by cold widening or expansion after the seam welding on the inside and the outside.

German Patent Disclosure DE 41 24 689 A1 shows a method and an apparatus for eliminating shape errors and diminishing harmful intrinsic stresses in the longitudinal seam of welded extruded tubes, also by widening the tube, for which purpose a widening mandrel located on the inside is employed. The widening of the extruded tube is done to such an extent that intrinsic stresses present in the circumferential direction are intended to be diminished as much as possible.

In straightening tubes, nonuniformities in the tube shape, such as local ovality on the tubular body, are corrected by local shaping of material. Stress is not diminished uniformly by way of the tube jacket, in particular the tube circumference. Instead, additional undefined stresses are generated in the material by the known local ovality corrections. Although a target diameter can be established through a relatively great effort in this way, with the straightening, a uniform upsetting strength of the material over the circumference of the tube, in particular, fails to be achieved.

In the expansion method, the tools generate a uniform force on the inside of the tube, and in the concentric straightening, this puts the material uniformly into a circular shape. In this operation, however, unfavorable stress states can be created in the tubular body, and as a result the upsetting strength and hence the resistance to collapsing of the pipeline may lessen. In coated tubes, so-called clad tubes, damage to the material can also occur, so that such tubes can often not be calibrated by this method. Such adverse effects can be further amplified with an increasing degree of expansion.

SUMMARY OF THE INVENTION

One object of this invention is to provide a method for producing large steel tubes with which the manufacture of high-quality tubes is achieved with the most precise possible concentric straightening and the shortest possible production time, and to furnish correspondingly embodied tubes, in which the mechanical-technological properties of the material are also to be improved.

This object is attained with the characteristics of this invention as set forth in this specification and the claims. In one method having characteristics according to this invention, in a step for concentric straightening, the stress-relieving treatment is performed with cold forming by upsetting, along a circumference of at least in some portions with respect to the longitudinal axis of the tube.

With the provisions in the combination recited, not only can the target diameter be established properly, but in the process of the concentric straightening, a stress-relieving treatment is also done. In this way, not only is the tube tolerance, especially the ovality, improved in a short time by uniform plastic deformation of the material, but the intrinsic stress performance of the tubular body is improved as well. Not only are the stresses generated by forming the sheet-metal material mechanically in the fundamental material reduced, but the thermally created stresses caused by the longitudinal seam welding of the sheet-metal material formed to make the tube are diminished as well. Overall, the mechanical-technological properties of the tube are improved by the method, such as the upsetting strength and the collapsing resistance, for example. As calculations in the context of research and development work have proven, the intrinsic stress performance after impansion, depending on the degree of impansion, is reduced to a minimum, and diminishing stress practically completely is made possible, without requiring a complicated heat treatment, such as a low-stress annealing, for instance at approximately 600° C., and advantages arising from the heat treatment can be avoided. Because of the uniform upsetting over the outer surface of the tube, the intrinsic stresses generated by the production process diminish in the longitudinal and circumferential directions in the basic material and in the welded seam. As experiments by the applicants have shown, one reason for the improvements is evidently that the residual stress state is reversed. After the impansion, there is tensile stress on the inside of the tube and compressive stress on the outside of the tube. With raw materials plated on the inside, the impansion from outside provides additional advantages, since the vulnerable inside surface is not damaged or strained. As a result, there is no lessening of the corrosion properties of the internal material. In coating materials, for instance from alloy 625, the corrosion resistance is even improved from internal residual stresses.

One advantageous provision for concentric straightening and stress relief is that in the concentric straightening, plastic deformation of the tubular body is done over its entire circumference.

Alternative advantageous features for exact concentric straightening include that in the concentric straightening, an adjustment to predetermined outside tube diameters or predetermined inside tube diameters is done.

Further contributing to improving the intrinsic stress performance of the tubular body are the provisions that in the concentric straightening for stress relief, upsetting in the circumferential direction and hydraulic stress relief, for example with a hydrotester, are combined with one another. The impansion and hydraulic stress relief can also be done in a controlled way multiple times in alternation.

The concentric straightening and the stress relief processes are also promoted by the fact that the concentric straightening and stress relief are performed by at least two and in particular at least three welding devices, offset in the circumferential direction and pressing from outside in the radial direction toward the tube axis, that have straightening shells which in some portions are adapted to the circumferential contour of the tube.

A tube with advantageous properties is obtained by being produced by one of the aforementioned procedures.

BRIEF DESCRIPTION OF THE DRAWINGS

This invention is described below in view of exemplary embodiments shown in the drawings, wherein.

DETAILED DESCRIPTION OF THE INVENTION

Figure 1:
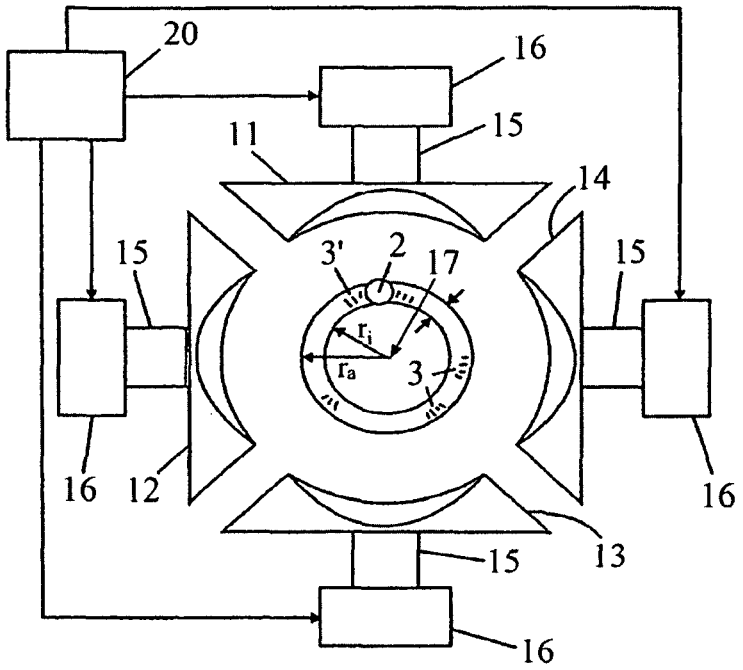
FIG. 1 shows a tube, disposed in a concentric straightening machine, in a schematic cross-sectional view.

FIG. 1 in an axial plan view shows a tube 1 of round cross section, with an inner radius $r_i$ and an outer radius $r_a$, the difference between which defines a wall thickness t. The tube 1 has a longitudinally extending welded seam 2. In the tube wall, mechanical and thermal stress regions 3, 3' are present, as a consequence of the mechanical forming process and as a consequence of the influence of heat in the welding.

The straightening machine or straightening device 10 has a plurality of welding devices, distributed uniformly in the circumferential direction and disposed at an identical location in the axial direction, each with respective straightening shells 11, 12, 13, 14, which are mounted replaceably each on their own holder 15 and are provided, on their side toward the tube 1, with a surface form adapted to the surface contour of the tube 1, which surface form extends in the circumferential direction along the tube surface, so that when all the straightening shells are in contact, the tube surface is largely surrounded in the circumferential direction. In the axial direction, conversely, the straightening shells 11, 12, 13, 14 extend over only a short portion of the tube 1, and a plurality of such units comprising straightening shells 11, 12, 13, 14 can be disposed in the longitudinal direction of the tube 1, over its outer surface. Because of the replaceability, straightening shells adapted to different tube diameters can easily be inserted or changed. The holders 15 of the straightening shells 11, 12, 13, 14 are adjusted hydraulically along a closed-loop control axis 17 in the radial direction, oriented toward the center of the tube 1, in the support 16, in order to accomplish upsetting of the tubular body and hydraulic stress relief in the opposite direction, with open-loop or closed-loop control by a regulating device 20. Straightening to predetermined inside diameters or outside diameters can be done, and an absolute position can be predetermined via the regulating device.

Figure 2:
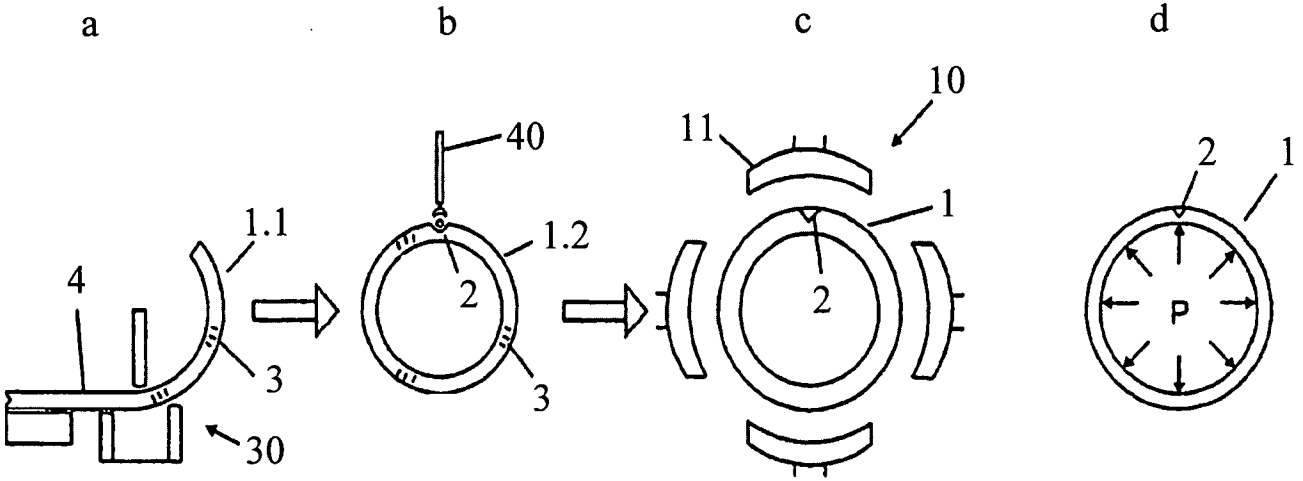
FIG. 2 is a schematic view of steps in manufacturing a tube.

FIG. 2 shows essential steps in the production of the tube 1, namely a forming process a, in which a sheet-metal plate 4 is gradually shaped, by a forming device 30 by forming tools, with advancement of the sheet-metal plate 4, into a bent portion 1.1 and finally into the tubular body 1.2 bent all the way around. Next, the tubular body 1.2, on its edges facing one another, which have been prepared beforehand for the welding, are closed in a welding process b by a longitudinal welded seam in a welding device 40. As a result of the forming processes and the welding, mechanical and thermal stress regions 3, 3' are created, as mentioned above. Next, possibly after further processing and/or monitoring steps have been performed, a straightening process c with concentric straightening of the tube 1 is done, in which at the same time a stress-relieving treatment also takes place. The stress-relieving treatment can additionally be combined in an ensuing step d with hydrostatic stress relief, for instance by a hydrotester, in which by a pressure medium in the tube interior, an outward-oriented pressure p on the inner tube surface is generated.

In large tubes, such as those in particular with wall thicknesses t 9 mm and diameters d≥300 mm, for example up to t=80 mm and d=2000 mm, the concentric straightening with uniform calibration over the circumference is successful with the straightening machine mentioned above, of the kind also shown in German Patent Reference DE 10 2006 010 040 B3 mentioned above, with which upsetting of the material in the circumferential direction and concentric straightening with high tolerance requirements are achieved, and upsetting beyond the elongation limit is possible. By plastic deformation in the concentric straightening, stress relief of both mechanical and thermal stress regions 3, 3' can simultaneously be achieved over the entire circumference. As a result, the intrinsic stress performance of the tubular body is improved markedly without an additional heat treatment, and at the same time, negative influences, of the kind that can occur as a result of a heat treatment, for instance in low-stress annealing, are avoided. Thus not only are the stresses caused mechanically by the forming of the sheet-metal material reduced, but the thermally generated stresses caused by the longitudinal seam welding are also diminished, and the plastic deformation of the tubular body 1.2 takes place over the entire tube circumference. The concentric straightening with the stress-relieving treatment is achieved by cold forming.

By the combination of the impansion and hydraulic stress relief with open-loop or closed-loop control via the regulating device 20, the stress relief process can be varied in a targeted way. At the same time, outside tube diameters or inside tube diameters can be adjusted in a targeted way to predetermined values. With this method, the mechanical-technological properties, such as strength and thermal expansion coefficient of the raw material, can be favorably affected in a targeted way. Also, the collapsing performance of the tube and the properties under fatigue strains are improved. Overall, high-quality, practically stress-free tubes with high tube tolerances can be manufactured in a markedly shorter time than in conventional production processes. As has been proven in research and development work by calculations, the intrinsic stress performance after the impansion, depending on the degree of impansion, can be reduced to a minimum, and diminishing stress entirely is even possible.

The invention claimed is:

1. A method for producing a steel tube, comprising:

forming a tubular body having a round cross section from a metal sheet or coil in a bending process;

welding the metal sheet or coil along longitudinal edges facing one another to produce a continuous seam;

processing the tubular body in a concentric straightening operation, wherein the concentric straightening is performed by at least three hydraulically adjustable straightening devices offset in the circumferential direction and pressing from an outside in the radial direction toward a tube axis, and that have straightening shells adapted in some portions to the circumferential contour of the tubular body;

subjecting the tubular body to a stress-relieving treatment by combining the concentric straightening operation with the stress-relieving treatment comprising cold forming by upsetting along a circumference in at least one portion with respect to a longitudinal axis, wherein the stress-relieving treatment is performed by plastic deformation of the tubular body via hydraulic adjustment of the at least three straightening devices; and the stress-relieving treatment further comprising a step of hydraulic stress relief following the step of cold forming by upsetting, the hydraulic stress relief comprising generating an outward-oriented pressure on an inner tube surface by a pressure medium within the tube interior.

2. The method according to claim 1, further comprising performing the plastic deformation of the tubular body during the concentric straightening over an entire circumference of the tubular body.

3. The method according to claim 2, wherein in the concentric straightening there is an adjustment to predetermined outside tube diameters ($r_a$) or predetermined inside tube diameters ($r_i$).

4. The method according to claim 1, wherein in the concentric straightening there is an adjustment to predetermined outside tube diameters ($r_a$) or predetermined inside tube diameters ($r_i$).

5. The method according to claim 1, further comprising hydraulically adjusting the straightening shells in a radial direction to a first and inward position for the upsetting and to a second and outward position for the hydraulic stress relief.

6. The method according to claim 5, further comprising multiple alternations of and between the cold forming by upsetting and the hydraulic stress relief.

7. A method for producing a steel tube, comprising:

forming a tubular body having a round cross section from a metal sheet or coil in a bending process;

welding the metal sheet or coil along longitudinal edges facing one another to produce a continuous seam;

processing the tubular body in a concentric straightening operation; and subjecting the tubular body to a stress-relieving treatment comprising alternating between: impansion and plastic deformation from cold forming by upsetting along a circumference in at least one portion with respect to a longitudinal axis during the concentric straightening operation, and hydraulic stress relief by generating an outward-oriented pressure on an inner tube surface by a pressure medium within the tube interior;

wherein the concentric straightening and the impansion and plastic deformation of the upsetting are performed by at least three hydraulically adjustable straightening devices, offset in the circumferential direction and pressing from an outside in the radial direction toward a tube axis, that have straightening shells (11, 12, 13, 14) adapted in some portions to the circumferential contour of the tube (1);

hydraulically adjusting the straightening shells during the stress-relieving treatment in a radial direction to inward positions for the impansion and plastic deformation of the upsetting and to an outward position for the hydraulic stress relief; and performing multiple alternations of and between the cold forming by upsetting and the hydraulic stress relief.

* * * * *